US006684435B1

(12) United States Patent
Wells

(10) Patent No.: US 6,684,435 B1
(45) Date of Patent: Feb. 3, 2004

(54) METHOD OF MANUFACTURING BEDDING OR SEATING PRODUCT HAVING COAXIAL COIL SPRINGS

(75) Inventor: Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/279,559

(22) Filed: Oct. 24, 2002

(51) Int. Cl.[7] ..... A47C 27/07
(52) U.S. Cl. ..... 5/720; 5/727; 5/248; 5/654.1
(58) Field of Search ..... 5/720, 727, 654.1, 5/248, 256; 267/93

(56) References Cited

U.S. PATENT DOCUMENTS

| | | | | |
|---|---|---|---|---|
| 1,192,510 A | | 7/1916 | Fischmann | |
| 2,567,520 A | * | 9/1951 | McInerney | 267/93 |
| 4,439,977 A | | 4/1984 | Stumpf | |
| 5,509,642 A | | 4/1996 | Wells | |
| 5,803,440 A | | 9/1998 | Wells | |
| 6,101,697 A | | 8/2000 | Stumpf et al. | |
| 6,143,122 A | | 11/2000 | Mossbeck et al. | |
| 6,173,464 B1 | * | 1/2001 | McCune et al. | 5/720 |
| 6,374,442 B1 | | 4/2002 | Wells | |

FOREIGN PATENT DOCUMENTS

| | | |
|---|---|---|
| WO | WO 94/18116 | 8/1994 |

* cited by examiner

*Primary Examiner*—Teri Pham Luu
*Assistant Examiner*—Fredrick Conley
(74) *Attorney, Agent, or Firm*—Wood, Herron & Evans, L.L.P.

(57) ABSTRACT

A bedding or seating product comprises a pocketed spring assembly having a plurality of parallel strings of springs joined to each other. Each of said strings of springs comprises a row of interconnected pockets, each of the pockets containing at least one spring encased in a fabric pocket. Some of the pockets contain two coil springs, an outer spring and an inner spring, the inner spring extending between the end turns of the outer spring and being wound generally coaxially with the outer spring. The end turns of the inner and outer coil springs are adjacent one another.

8 Claims, 5 Drawing Sheets

METHOD OF MANUFACTURING BEDDING OR SEATING PRODUCT HAVING COAXIAL COIL SPRINGS

FIELD OF THE INVENTION

This invention relates generally to spring assemblies for use in mattresses, spring upholstered furniture and the like and, more particularly, to a posturized pocketed coil spring assembly and associated method of manufacturing such an assembly.

BACKGROUND OF THE INVENTION

A well known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string of pocketed springs. A bedding or seating product can be fabricated from such strings of pocketed springs by binding or adhering the individual rows or strings of pocketed springs together to form a spring assembly which may be padded and encased in an upholstered covering. U.S. Pat. No. 6,143,122 discloses one such method of adhesively bonding strings of pocketed springs together to form a spring assembly.

This type of spring assembly is commonly referred to as a pocketed spring unit due to the fact that each spring is contained within an individual pocket of fabric material. The construction of strings of pocketed coil springs in each pocket is well known in the art and, for example, is disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO94/18116 and U.S. Pat. No. 6,101,697, each of which are expressly incorporated herein by reference.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

One particular aspect of the commercial production of pocketed spring assemblies and the associated mattresses or the like is the handling of such assemblies in the factories. The manipulation and movement of the various components of the spring assembly from station to station or various areas of the factories can be cumbersome, difficult and inconvenient depending on the particular production facilities and assembly techniques.

Additionally, while pocketed spring assemblies are considered to provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

One known method of posturizing a pocketed spring unit has been to incorporate springs made of different gauge wire into the strings of springs. For example, the springs incorporated into the strings of springs within certain sections or zones of the spring assembly are made of a larger gauge wire than the springs incorporated into the strings of springs of the other sections or zones of the spring assembly. U.S. Pat. No. 6,173,464 discloses this concept, albeit with continuous bands of springs as opposed to individual springs.

Therefore, there is a need for a posturized pocketed spring assembly and associated method of manufacture which offers the advantages of posturization of the spring assembly without the higher manufacturing costs, production difficulties and inefficiencies associated with known posturized pocketed spring assemblies.

SUMMARY OF THE INVENTION

The invention of this application which accomplishes these and other objectives comprises a bedding or seating product comprising a pocketed coil spring assembly surrounded in an upholsted covering and associated method of manufacture.

The pocketed spring assembly comprises a plurality of parallel strings of springs joined to each other, each of the strings of springs comprising a row of interconnected pockets. Each of the pockets contain at least one coil spring encased in fabric. Each of the coil springs having an upper end turn, a lower end turn and a plurality of central convolutions between the end turns. Preferably, each string of springs is made of one piece of fabric folded and welded into a plurality of pockets, each of the pockets containing at least one coil spring. Opposed plies of the string of springs may be joined be sewing, gluing or sonic welding, as know in the art.

In each of the embodiments of the present invention, the pocketed spring assembly is posturized, meaning select sections, areas or regions of the pocketed spring assembly are firmer than other sections, areas or regions of the pocketed spring assembly. This difference in firmness is attributable to incorporating different numbers of coil springs into the pockets of fabric within the different sections, areas or regions of the pocketed spring assembly. The coil springs may be all made of the same gauge wire or made of different gauge wire.

Within the posturized pocketed spring assembly, select pockets of select strings of springs contain an outer coil spring and an inner coil spring, while other pockets of select strings of springs contain only one coil spring. The inner coil spring extends between said end turns of the outer coil spring and is wound generally coaxially with the outer coil spring such that the end turns of the inner and outer coil springs are adjacent one another. The areas of the pocketed spring assembly in which the pockets contain two coil springs are firmer than the areas of the pocketed spring assembly in which the pockets contain only one coil spring.

Although two coil springs are illustrated and described in select pockets of select strings of springs, more than two coil springs may be nested inside such pockets if desired.

Similarly, springs other than coil springs may be used in accordance with the present invention, if desired.

One or more layers of padding may be placed on top of the pocketed coil spring assembly. An upholstered covering surrounds the padding and pocketed spring assembly. At least one border wire may be secured to the spring assembly, if desired.

In one embodiment of the present invention, the perimeter of the product has a greater firmness than the remaining central portion of the product due to the pockets around the perimeter of the product having at least two coil springs while the pockets in the central portion of the product have only one coil spring therein.

In other alternative embodiments, the product is divided into longitudinally spaced regions of differing firmnesses. In one such embodiment, the product has three longitudinally spaced regions of differing firmnesses, a head section, a center section and a foot section. The firmness of the center section is greater than the firmness of the head and foot sections due to the pockets of the center section having at least two coil springs therein while the pockets in the head and foot sections of the product have only one coil spring therein.

In another such embodiment, the product has four longitudinally spaced regions of differing firmnesses: a head section, upper and lower lumbar sections and a foot section. The firmness of the upper and lower lumbar sections being greater than the firmness of the head and foot sections due to the pockets of the upper and lower lumbar sections having at least two coil springs therein while the pockets in the head and foot sections of the product have only one coil spring therein.

In accordance with the present invention, a bedding or seating product may have any number of sections of different firmness oriented longitudinally or transversely due to the number of coil springs inside the pockets which are located within the sections.

In any of the embodiments described above, the strings of springs may be oriented transversely or longitudinally. Depending upon the desired application, all the pockets within a string of springs may contain two coil springs. Alternatively, only select pockets within a string of springs may contain two coil springs for improved firmness in select areas.

The method of manufacturing the posturized spring assembly of the present invention varies depending upon the desired posturization. However, in each of the applications of the present invention whenever two coil springs are to be inserted into a pocket, the inner spring is nested inside the outer spring to form a spring group prior to the spring group being inserted into the pocket of the string of springs.

In one method of manufacturing a posturized bedding or seating product in accordance with the present invention, only one coil spring is inserted into select pockets of a string of springs while two coil springs are inserted into other pockets of the string of springs. Once all of the pockets have been filled with at least one coil spring, the pockets are closed. Alternatively, each pocket may be closed immediately after the coil spring or coil springs is inserted therein. The finished string of springs is then joined to adjacent finished strings of springs to form a spring assembly. The adjacent strings of springs may be manufactured the same way or alternatively have each pocket of the string contain only one coil spring or two coil springs, i.e. be uniform along its length.

In each of the embodiments of the present invention, incorporating different numbers of coil springs into the pockets of the strings of springs results in a posturized pocketed spring assembly after multiple strings of springs are joined. Such a product may be made in accordance with a customer's needs and desires quickly and easily.

BRIEF DESCRIPTION OF THE DRAWINGS

These objectives and features of the invention will become more readily apparent from the following detailed description taken in conjunction with the accompanying drawings in which.

DETAILED DESCRIPTION OF THE INVENTION

Figure 1:
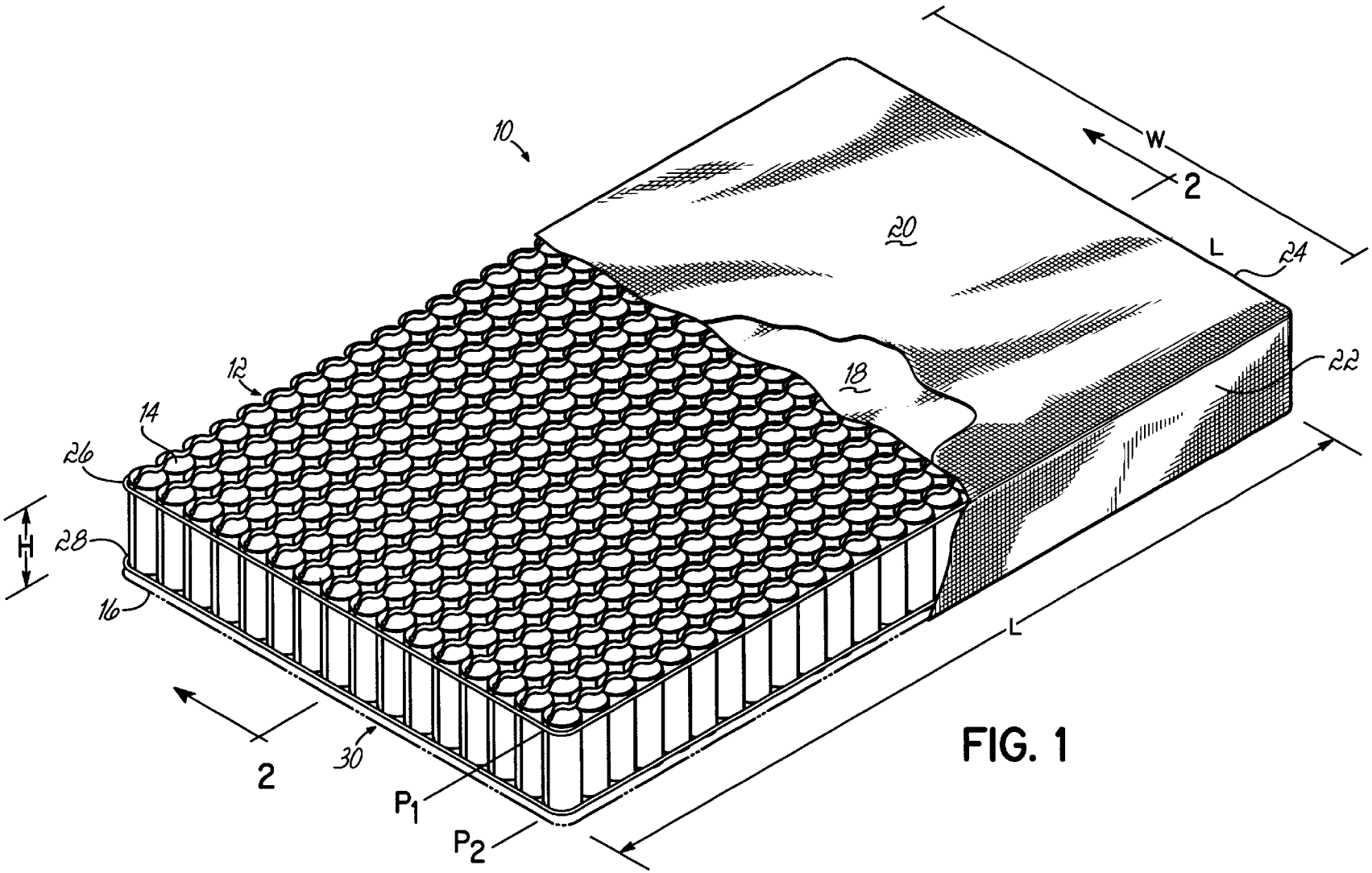
FIG. 1 is a perspective view of a bedding or seating product having a pocketed spring assembly according to one embodiment of this invention.

Referring to the drawings, particularly to FIG. 1, there is illustrated a bedding or seating product in the form of a mattress 10. Although a mattress 10 is illustrated, the present invention may be used to construct any bedding or seating product. The mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces 14, 16 of the pocketed spring assembly 12. An upholstered covering 20 encases the pocketed spring assembly 12 and the covering pads 18.

The mattress 10 has a height H defined as the distance between the top and bottom surfaces 14, 16 of the spring assembly 12. Similarly, the mattress 10 has a transverse dimension or width W defined between opposed side surfaces 22 and a longitudinal dimension or length L defined as the distance between the opposed end surfaces 24 of the mattress 10. The longitudinal dimension is illustrated as being larger than the transverse dimension of the mattress 10 although it is within the contemplation of the present invention that the longitudinal and transverse dimensions be identical, such as in a square product.

If desired, at least one border wire may be secured to the pocketed spring assembly 12 with hog rings or any other conventional fastener 13. FIG. 1 illustrates an upper border wire 26 and a lower border wire 28, both of which are generally rectangular, secured to the pocketed spring assembly 12. However, only one border wire may be used, if desired.

Figure 2:
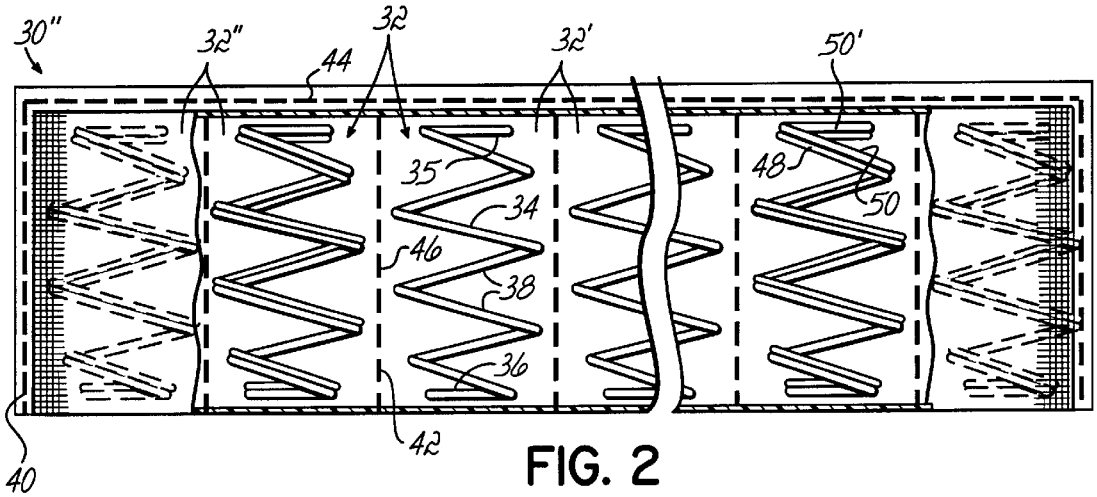
FIG. 2 is a cross-sectional view taken along line 2—2 of the product of FIG. 1.
Figure 3:
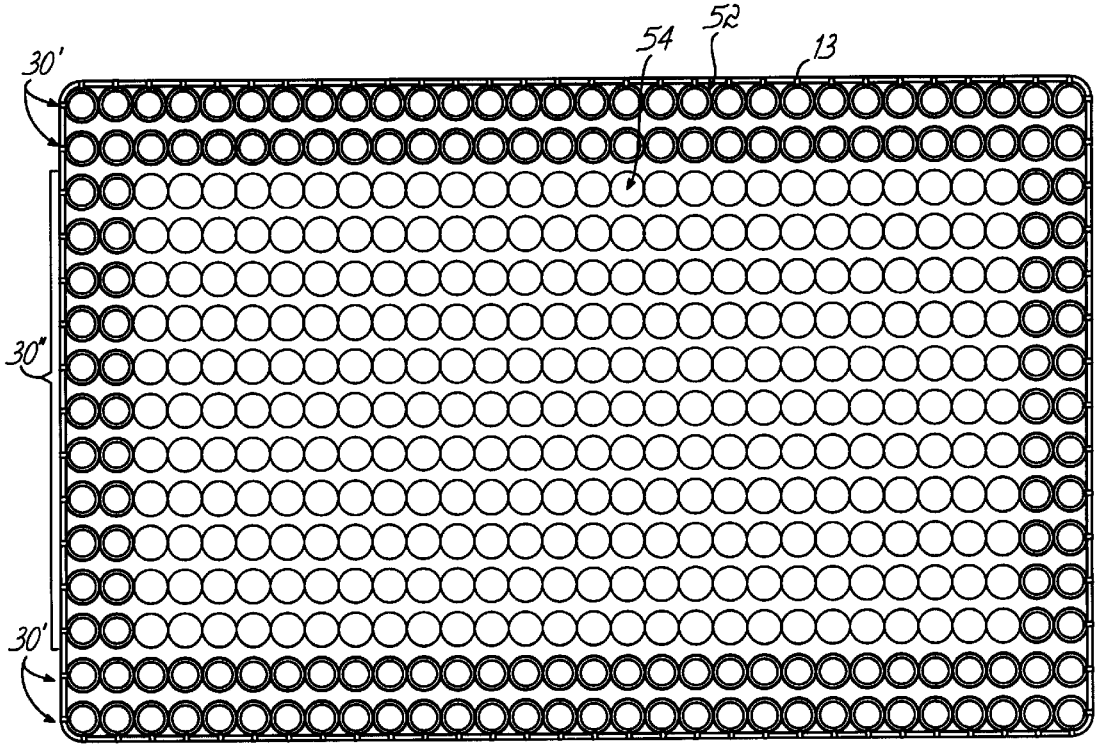
FIG. 3 is a top plan view of the product of FIG. 1.

The pocketed spring assembly 12 comprises a plurality of longitudinally extending strings of springs 30, including four outermost strings of springs 30' and multiple internal strings of springs 30". Referring to FIG. 3, the mattress 10 has four outermost strings of springs 30, two on each side, and a plurality of internal strings of springs 30". FIG. 2 illustrates one of the internal strings of springs 30".

Referring to FIG. 2, each internal string of springs 30" comprises a row of interconnected fabric pockets 32 including four outermost pockets 32", two at each end, and a plurality of internal pockets 32' between the outermost pockets 32". Each of the fabric pockets 32' contains at least coil spring 34 having an upper end turn 35, a lower end turn 36 and a plurality of central convolutions 38 between the end turns 35, 36. Preferably, only one piece of fabric is used to form a string of springs 30, the piece of fabric being folded over onto itself around the coil springs 34. As is known in the art, opposite sides or plies of the fabric are sewn, welded or otherwise secured together in order to create a pair of outermost seams 40, a plurality of internal seams 42 and a top seam 44. The internal seams 42 separate adjacent pockets 32 and therefore adjacent coil springs 34. Although the seams 40,42 and 44 are illustrated as being a plurality of spaced, linear segments 46, they may comprise continuous lines or a series of dots or other arrangement without departing from the spirit of this application.

As illustrated in FIG. 2, each of the outermost pockets 32" at each end of the internal string of springs 30' has two coil springs encased therein, an outer coil spring 48 and an inner coil spring 50. The inner coil spring 50 extends between the end turns of the outer coil spring 48 and is wound generally coaxially with the outer coil spring 48 such that the end turns of the inner and outer springs 50,48 are adjacent one another and may contact one another.

As seen in FIGS. 1–3, each of the internal strings of springs 30' has only one coil spring 34 in the internal pockets 32', i.e. those pockets between the outermost pairs of pockets 32" and two coil springs 48, 50 in each of the outermost pockets 32".

As shown in FIG. 3, all of the pockets 32 in each of the outermost strings of springs 30" on each side of the mattress 10, contain two coil springs 34. Thus, the outermost strings of springs 30" have a firmness greater than the internal portions of the internal strings of springs 30'.

As best illustrated in FIG. 3, the mattress 10 has a perimeter portion or section 52 surrounding a central portion or section 54. The firmness of the perimeter portion 52 is greater than the firmness of the central portion 54 of the mattress due to all of the pockets within the perimeter portion 52 containing two coil springs 48, 50 while all of the pockets within the perimeter portion 52 contain only one single coil spring 34. Although the strings of springs 30', 30" are longitudinally extending, this embodiment of the present invention may also be manufactured with transversely extending strings of springs.

Figure 4:
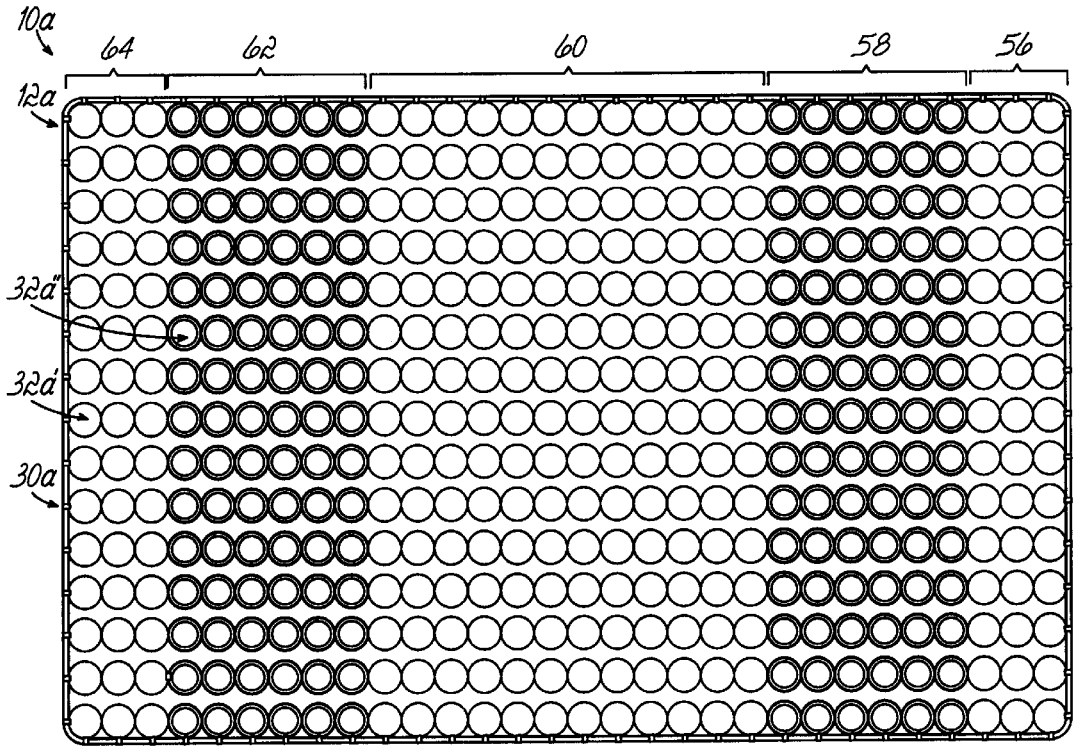
FIG. 4 is a top plan view of an alternative embodiment of the present invention.

FIG. 4 illustrates an alternative embodiment of the present invention. In this embodiment, the mattress 10*a* has a pocketed spring assembly 12*a* which is divided into multiple regions or sections as one moves longitudinally down the side of the mattress. At one end of the mattress 10*a* is a head section 56, immediately adjacent head section 56 is an upper lumbar section 58, immediately adjacent upper lumbar section 58 is a middle lumbar section 60, immediately adjacent middle lumbar section 60 is a lower lumbar section 62, and at the other end of mattress 10*a* is a foot section 64.

The pocketed spring assembly 12*a* comprises a plurality of longitudinally extending strings of springs 30*a*, each being identical. Each string of springs 30*a* has several series of pockets 32*a*' each containing only one coil spring and several series of pockets 32*a*" each containing two coil springs. The pockets 32*a*' of the strings of springs 30*a* which are located in the head section 56, middle lumbar section 60 and foot section 64 contain only one coil spring and the pockets 32*a*" of the strings of springs 30*a* which are located in the upper and lower lumbar sections 58, 62 contain two coil springs. Therefore, the upper and lower lumbar sections 58, 62 are firmer than the head, middle lumbar and foot sections 56, 60 and 64. Although the strings of springs 30*a* are longitudinally extending, this embodiment of the present invention may also be manufactured with transversely extending strings of springs. If the strings of springs were transversely extending, each string of springs in the upper and lower lumbar sections 58, 62 would have two coil springs in each of its pockets and each string of springs in the head, middle lumbar and foot sections 56, 60 and 64 would have only one coil spring in each of its pockets.

Figure 5:
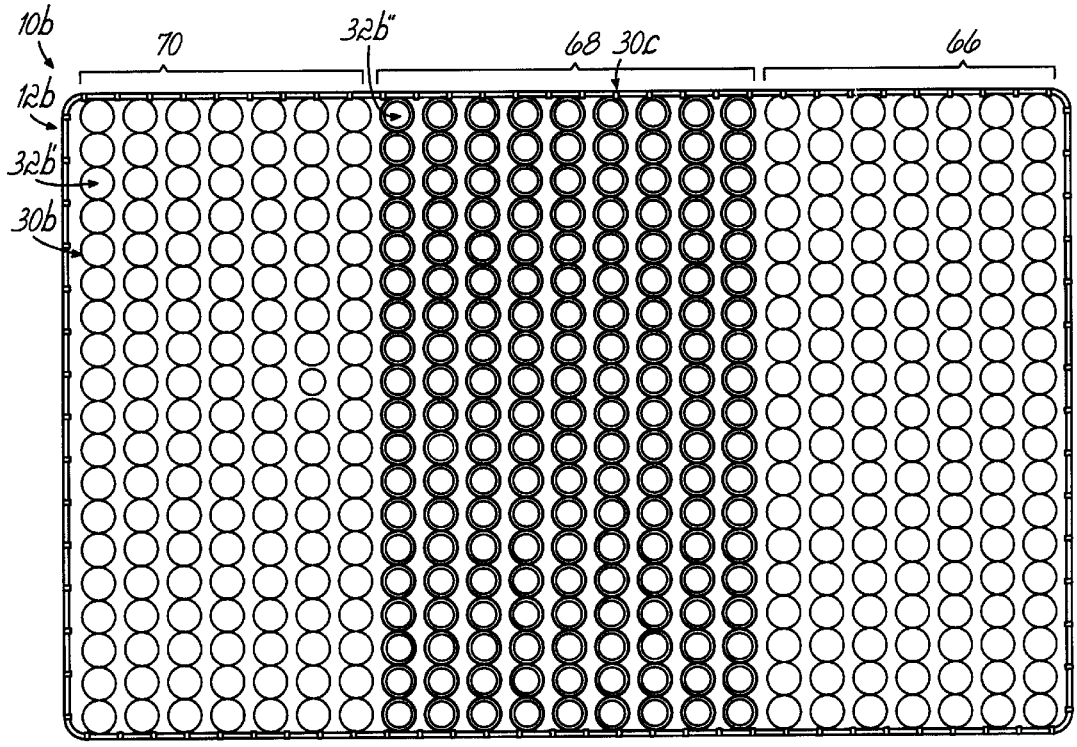
FIG. 5 is a top plan view of another alternative embodiment of the present invention.

FIG. 5 illustrates another alternative embodiment of the present invention. In this embodiment, the mattress 10*b* has a pocketed spring assembly 12*b* which is divided into multiple regions or sections as one moves longitudinally down the side of the mattress. At one end of the mattress 10*b* is a head section 66, immediately adjacent head section 66 is a center section 68, and at the other end of mattress 10*b* is a foot section 70.

The pocketed spring assembly 12*b* comprises a plurality of transversely extending strings of springs 30*b*. Each string of springs 30*c* in the head and foot sections 66, 70 has pockets 32*b*' each containing only one coil spring. Similarly, each string of springs 30*b* in the center section 68 has pockets 32*b*" each containing two coil springs. Therefore, the center section 68 is firmer than the head and foot sections 66, 70. Although the strings of springs 30*b* and 30*c* are illustrated as being transversely extending, this embodiment of the present invention may also be accomplished with longitudinally extending strings of springs. If the strings of springs were longitudinally extending, each string of springs would have a middle section or region located in the center section 68 of the mattress 10*b* and end sections or regions located in the head and foot sections 66, 70 of the mattress 10*b*. Each pocket of each string of springs in the center section of the string of springs would contain two coil springs and each pocket in the end sections of the string of springs would contain only one coil spring.

Figure 6:
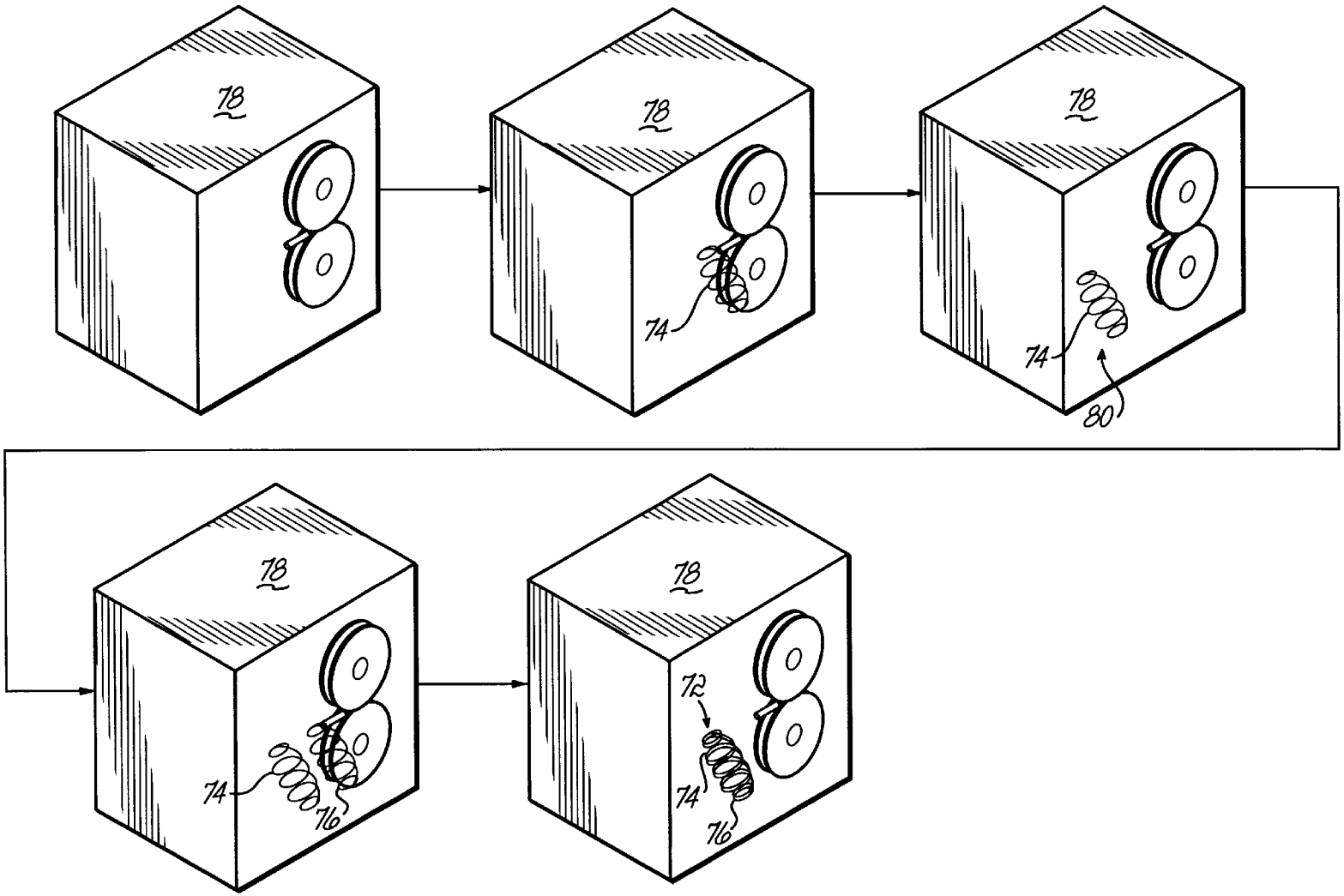
FIG. 6 is a schematic diagram of the process of making a spring group in accordance with the present invention.

FIG. 6 illustrates the method of creating a spring group 72 comprising an outer coil spring 74 and an inner coil spring 76. First, the outer coil spring 74 is formed by a spring coiler 78. The outer coil spring 74 is then set aside to a location indicated by the numeral 80 in FIG. 6. The spring coiler 78 then forms the inner coil spring 76 which is then nested into the outer coil spring 74. When nested, the inner coil spring 76 extends between the end turns of the outer coil spring 74 and is would generally coaxially with the outer coil spring 74. When nested, the end turns of the inner and outer coil springs are immediately adjacent one another and preferably in contact.

Figure 7:
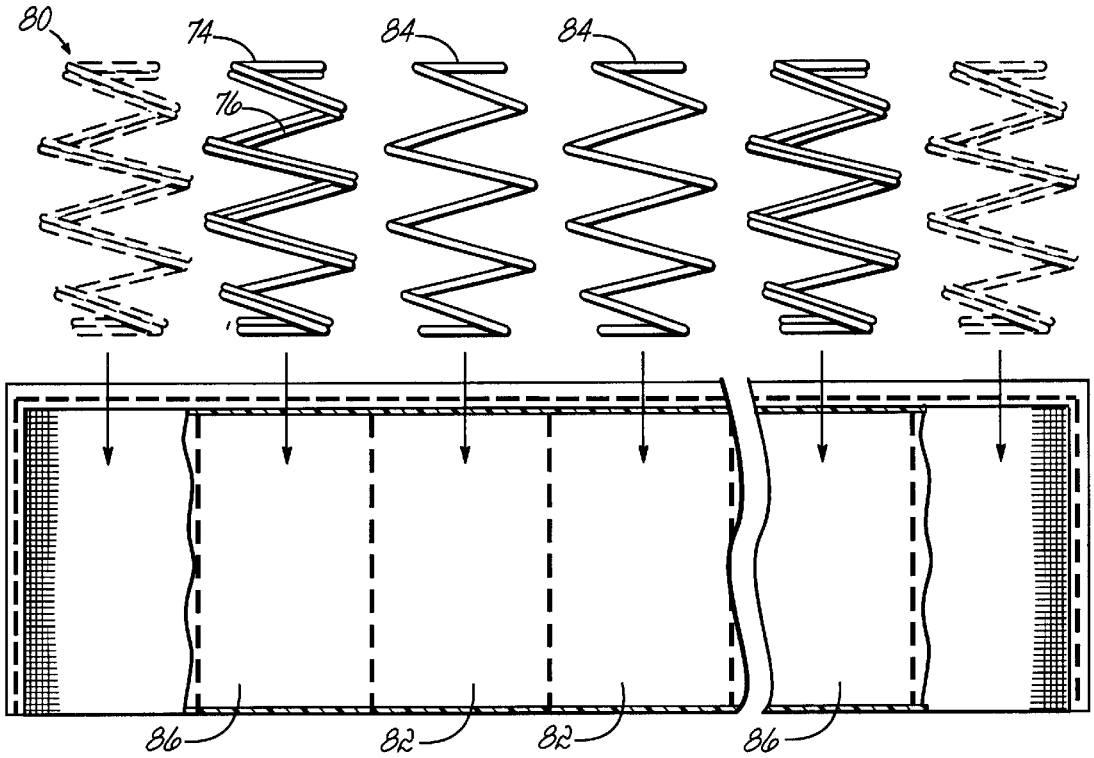
FIG. 7 is a side elevational view of springs being inserted into pockets of a string of springs in accordance with the present invention.

FIG. 7 illustrates the process of making a string of springs 80 having pockets 82 with single coil springs 84 therein and pockets 86 with two coil springs 74, 76 therein, like the string of springs 30' illustrated in FIG. 2. In this process, the single coil springs 84 are inserted into the pockets 82 and the two coil springs 74, 76 inserted into the pockets 86. Each of the pockets 82 and 86 are then closed or sealed along the top so that fabric encases at least one coil spring in each pocket. The string of springs 80 is then joined to adjacent strings of springs to make the spring assembly. Lastly, the spring assembly is covered in an upholstered covering.

If the strings of springs is to have a uniform firmness along its length, either one coil spring or two nested coil springs are inserted into each pocket such that each pocket contains the same thing. The pockets are then closed. Such a string of springs is then joined to identical strings of springs to form a first set of strings of springs. This first set is joined to a second set of strings of springs which are of a different firmness than the first set. Thus a posturized pocketed spring assembly is formed with different regions or sections of differing firmness.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method of manufacturing a bedding or seating product comprising:

inserting into select pockets of a string of springs only one coil spring, closing said select pockets of said string of springs such that fabric encases one spring in each of said select pockets, forming a plurality of spring groups by nesting an inner spring inside an outer spring to form one of said spring groups, each of said coil springs having an upper end turn, a lower end turn and a plurality of central convolutions between said end turns, said inner spring extending between said end turns of said outer coil spring and being wound generally coaxially with said outer coil spring such that the end turns of the inner and outer coil springs are adjacent one another, inserting into other pockets of said string of springs one of said spring groups, closing said other pockets of said string of springs such that fabric encases one of said spring groups in each of said other pockets, joining said string of springs to adjacent strings of springs to form a spring assembly.

2. The method of claim 1 further comprising encasing the spring assembly in a fabric covering.

3. A method of manufacturing a bedding or seating product comprising first and second sets of strings of pocketed springs, each of said strings of pocketed springs having a row of interconnected pockets, said method comprising:

forming one of said strings of pocketed springs of said first set by inserting into each pocket of said string of pocketed springs of said first set only one coil spring and closing the pocket, forming said first set of strings of pocketed springs by joining together a plurality of said strings of pocketed springs of said first set, forming one of said strings of pocketed springs of said second set by inserting into the pockets of said string of pocketed springs of said second set spring groups, each spring group comprising an outer coil spring and an inner coil spring, each of said inner and outer coil springs having an upper end turn, a lower end turn and a plurality of central convolutions between said end turns, said inner spring extending between said end turns of said outer coil spring and being wound generally coaxially with said outer coil spring such that the end turns of the inner and outer coil springs are adjacent one another and closing the pockets after the spring groups are inserted therein, forming said second set of springs of pocketed springs by joining together a plurality of said strings of pocketed springs of said second set, joining said first and second sets of strings of springs to form a pocketed spring assembly.

4. The method of claim 3 further comprising encasing the pocketed spring assembly in a fabric covering.

5. A method of manufacturing a bedding or seating product comprising:

inserting into at least some pockets of a string of springs only one coil spring, and inserting into other pockets of said string of springs spring groups, each spring group comprising an outer coil spring and an inner coil spring, each of said coil springs having an upper end turn, a lower end turn and a plurality of central convolutions between said end turns, said inner spring extending between said end turns of said outer coil spring and being wound generally coaxially with said outer coil spring such that the end turns of the inner and outer coil springs are adjacent one another, closing all of said pockets of said string of springs after insertion of either a single coil spring or a spring group such that fabric encases at least one coil spring in each of said pockets, joining said string of springs to form a pocketed spring assembly.

6. The method of claim 5 further comprising encasing the pocketed spring assembly in a fabric covering.

7. A method of manufacturing a bedding or seating product comprising:

forming a plurality of spring groups, each of said spring groups being formed by nesting an inner spring inside an outer spring, each of said coil springs having an upper end turn, a lower end turn and a plurality of central convolutions between said end turns, said inner spring extending between said end turns of said outer coil spring and being wound generally coaxially with said outer coil spring such that the end turns of the inner and outer coil springs are adjacent one another, inserting into pockets of some strings of springs only one coil spring, inserting into pockets of other strings of springs one of the spring groups, closing all of said pockets of each of said string of springs such that fabric encases at least one coil spring in each of said pockets, joining said strings of springs to form a pocketed spring assembly.

8. A method of manufacturing a bedding or seating product comprising:

forming a plurality of spring groups by nesting an inner coil spring inside an outer coil spring, each of said coil springs having an upper end turn, a lower end turn and a plurality of central convolutions between said end turns, said inner coil spring extending between said end turns of said outer coil spring and being wound generally coaxially with said outer coil spring such that the end turns of the inner and outer coil springs are adjacent one another, inserting one spring group into pockets of a string of springs, closing said pockets after insertion of said spring groups, forming single coil springs, inserting one of said single coil springs into other pockets of said string of springs, closing said other pockets of said string of springs after insertion of said single coil springs into said other pockets, and joining a plurality of strings of pocketed springs to other identical strings of pocketed springs to form a pocketed spring assembly.

* * * * *

UNITED STATES PATENT AND TRADEMARK OFFICE

CERTIFICATE OF CORRECTION

PATENT NO. : 6,684,435 B1
DATED : February 3, 2004
INVENTOR(S) : Thomas J. Wells It is certified that error appears in the above-identified patent and that said Letters Patent is hereby corrected as shown below:

Column 1,
Line 41, change “each of which are” to -- each of which is --.

Column 2,
Line 35, change “contain” to -- contains --.
Line 35, change “in fabric. Each of the” to -- in fabric; each of the --.

Column 3,
Line 59, change “springs is ” to -- springs is/are --.

Column 6,
Line 49, change “would” to -- wound --.
Line 65, change “strings” to -- string --.

Column 7,
Line 63, change “springs of” to -- strings of --.

Column 8,
Line 20, change “string” to -- strings --.

Signed and Sealed this

Fifteenth Day of June, 2004

JON W. DUDAS
*Acting Director of the United States Patent and Trademark Office*